US008322970B2

(12) United States Patent
Ward et al.

(10) Patent No.: US 8,322,970 B2
(45) Date of Patent: Dec. 4, 2012

(54) CONVEYING AND STACKING APPARATUS FOR ACCURATE PRODUCT PLACEMENT

(75) Inventors: Lawrence Ward, Schwenksville, PA (US); Allen Ely, Downingtown, PA (US)

(73) Assignee: Packaging Progressions, Inc., Collegeville, PA (US)

( * ) Notice: Subject to any disclaimer, the term of this patent is extended or adjusted under 35 U.S.C. 154(b) by 420 days.

(21) Appl. No.: 12/634,113

(22) Filed: Dec. 9, 2009

(65) Prior Publication Data

US 2010/0189538 A1 Jul. 29, 2010

Related U.S. Application Data

(60) Provisional application No. 61/147,919, filed on Jan. 28, 2009.

(51) Int. Cl.
*B65G 57/02* (2006.01)

(52) U.S. Cl. ..... 414/794.4; 414/790.7; 198/721; 198/725

(58) Field of Classification Search ..... 198/688.1, 198/721, 722, 725, 861.1; 271/189, 190, 271/191, 192, 201; 414/789.9, 790.7, 791.9, 414/793.4, 793.5, 794.2, 794.4, 794.8, 924
See application file for complete search history.

(56) References Cited

U.S. PATENT DOCUMENTS

| | | | | | |
|---|---|---|---|---|---|
| 1,786,779 | A | * | 12/1930 | Quick | 198/721 |
| 3,768,807 | A | * | 10/1973 | Spengler | 271/190 |
| 3,789,973 | A | * | 2/1974 | Kugler | 198/345.1 |
| 3,870,141 | A | * | 3/1975 | Lapeyre et al. | 198/853 |
| 4,084,809 | A | * | 4/1978 | Looney | 271/220 |
| 4,103,767 | A | * | 8/1978 | Warner | 198/359 |
| 4,236,855 | A | * | 12/1980 | Wagner et al. | 414/789.5 |
| 4,255,074 | A | * | 3/1981 | Meratti et al. | 414/792 |
| 4,431,175 | A | * | 2/1984 | Smith | 271/10.08 |
| 4,925,362 | A | * | 5/1990 | Golicz | 414/790.7 |
| 5,253,762 | A | * | 10/1993 | Duncan | 209/552 |
| 5,564,892 | A | * | 10/1996 | Holbert | 414/793.1 |

FOREIGN PATENT DOCUMENTS

| | | | | |
|---|---|---|---|---|
| JP | 58063652 | A | * | 4/1983 |
| JP | 01203155 | A | * | 8/1989 |

* cited by examiner

*Primary Examiner* — Gregory Adams
(74) *Attorney, Agent, or Firm* — Volpe and Koenig, P.C.

(57) ABSTRACT

A conveying and stacking apparatus for stacking items or substrates carrying items received from an infeed conveyor is provided. The stacker has a housing and at least one movable platform upon which the item or substrate with one or more items located thereon is placed. An overhead loading belt assembly which includes at least one belt assembly positioned to travel over at least a portion of the infeed conveyor adjacent to the at least one moveable platform and the at least one moveable platform is provided. The at least one belt assembly carries the item or the substrate with the items located thereon to a stacking position on the at least one platform.

19 Claims, 4 Drawing Sheets

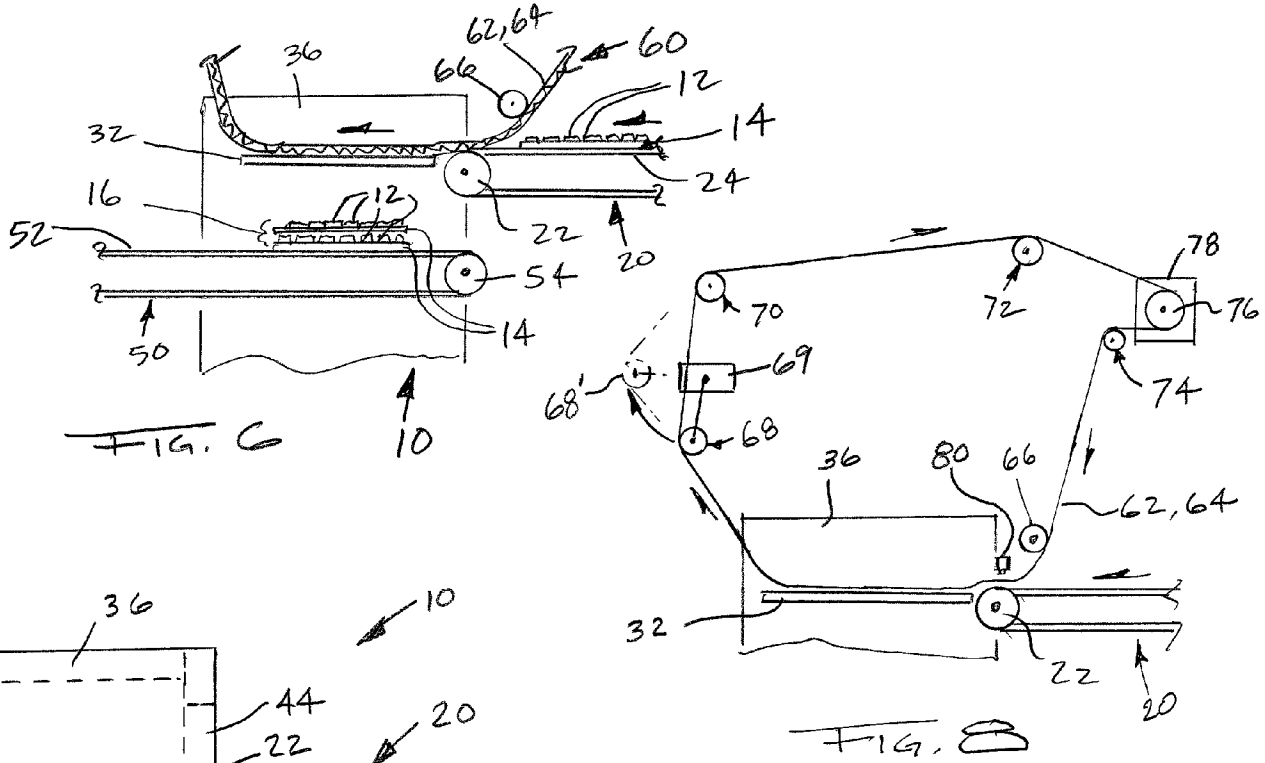
FIG. 6
FIG. 8
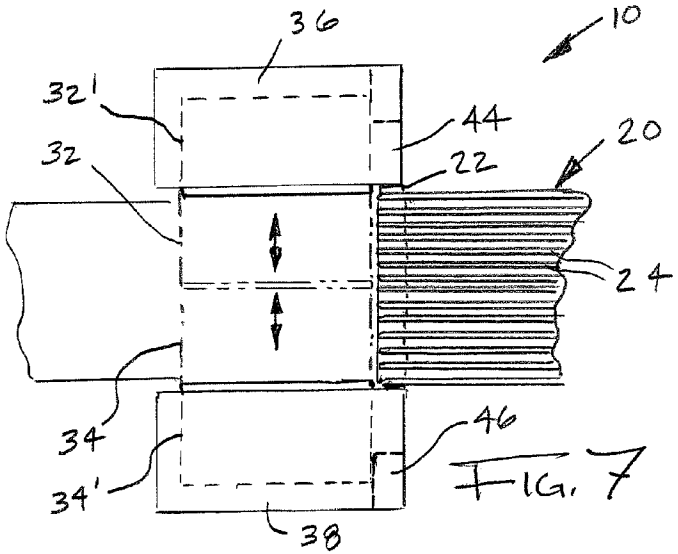
FIG. 7

CONVEYING AND STACKING APPARATUS FOR ACCURATE PRODUCT PLACEMENT

CROSS REFERENCE TO RELATED APPLICATION

This application is a Non-Provisional which claims the benefit of U.S. Provisional Application No. 61/147,919, filed Jan. 28, 2009, which is incorporated herein by reference as if fully set forth.

FIELD OF INVENTION

The invention relates to a conveying and stacking device, preferably for use in stacking food items alone or food items interleaved on a substrate, which are to be stacked in a fast and accurate manner for further packaging.

BACKGROUND

It is known in the art to use stacking equipment in order to stack individually produced items, such as frozen pizza shells, or a single layer of multiple items, such as sliced foods or cooked strips of bacon. These known stackers may stack the items directly on one another, such as is the case of frozen pizza shells, or can receive a substrate which carries a product or a plurality of slices of the product to be stacked. The individual product or product/substrate are carried onto a stacking platform, which can either be slidably or rotatably displaced in order to drop the item or substrate with the items thereon onto a lower level stacking position, which is generally on an outfeed conveyor. These systems have been known to operate with good results for stable items and/or items which do not slide on the substrate; however, for a variety of items, such as cooked bacon on a paper substrate a number of issues arise with respect to maintaining the items on the substrate while loading the item onto the stacker platform as well as during dropping of the items in order to form the stack. The non-uniformity of the items, with or without substrates, and the tendency of the items to slide on a substrate results in misalignments of the items and/or substrates with items, and also the loss of some of the items from the substrate as it is loaded on the stacker. Further, during the drop-stacking, if the substrates are not properly aligned and/or the items on the substrate have slid, the stack of substrates on the outfeed conveyor is formed without being uniformly aligned and/or there is a further loss of product from the substrates.

It would be desirable to provide a more uniform method for loading substrates carrying items which are to be stacked onto a stacker as well as to provide an improved stacking arrangement to create uniform stacks of items in operation.

SUMMARY

A conveying and stacking apparatus for stacking items received from an infeed conveyor is provided. The items may be individual items or items interleaved on a substrate. The stacker has a housing and at least one movable platform upon which the item or substrate/items to be stacked is placed. An overhead loading belt assembly which includes at least one belt assembly positioned to travel over at least a portion of the infeed conveyor adjacent to the at least one moveable platform and the at least one moveable platform is provided. The at least one belt assembly carries the item or substrate/items to a stacking position on the at least one platform.

Preferably, an outfeed conveyor is located under the stacker for receiving the items to be stacked.

Preferably, the overhead loading belt assembly includes a moveable roller that can be moved between a first position, where the at least one belt assembly is in contact with at least one of the at least one platform or the item/substrate/items to be stacked positioned on the at least one platform, and a second position, where the at least one belt assembly is located in a position that does not contact the at least one of the at least one platform or the item or substrate/items to be stacked that is positioned on the at least one platform.

In one embodiment, the at least one belt assembly comprises a polymeric link belt having a width that is about equal to or greater than a width of the substrate. Alternatively, the at least one belt assembly comprises a plurality of spaced apart chains, with the width defined between the outer-most ones of the chains being about equal to or greater than a width of the substrate.

Preferably, the overhead loading belt assembly includes a plurality of rollers for guiding the at least one belt assembly such that a slack portion of the belt assembly travels on the portion of the infeed conveyor adjacent to the at least one platform.

Preferably, a sensor is positioned to sense the substrate and/or the items thereon being carried onto the at least one platform. A controller controls movement of the at least one belt assembly based on a signal from the sensors so that the substrate with the items can be stopped in a repeatable location on the at least one platform of the stacker. Preferably, a controller further controls movement of the moveable roller of the overhead loading belt assembly in order to move the at least one belt assembly from the first position to the second position once the item or substrate/items is stopped in the repeatable location for stacking. The controller preferably also controls movement of the at least one platform such that it moves from the first, loading position, to a second, open position for dropping the item or substrate/items into a stacked position.

In one embodiment, the stacker includes first and second platforms that are slidable toward and away from one another in a direction transverse to a direction of movement of the at least one belt assembly. A particularly preferred arrangement includes the first and second platforms each having a plurality of rollers, with the rollers having axes arranged transverse to a direction of movement of the at least one belt assembly.

Preferably, a tensioning roller is located above the infeed conveyor for guiding the at least one belt assembly to a contact position with the infeed conveyor in proximity to an end roller adjacent to the at least one platform of the stacker. This is not only used for guiding the at least one belt assembly, but also prevents unwanted oscillating movements of the at least one belt assembly due to slack in the belt assembly which is required for achieving the desired contact with the substrate with the items thereon.

In another aspect, a method for stacking a plurality of items or substrates with one or more items is provided. The method includes:

- receiving a first item or a first substrate with one or more items thereon on an infeed conveyor;
- conveying the first item or first substrate with one or more items under an overhead belt assembly;
- moving the first item or first substrate with the one or more items with the overhead belt assembly onto at least one stacking platform;
- sensing the first item or first substrate with the one or more items entering the at least one platform and, based on a signal from the sensor, stopping the overhead belt assembly at a predetermined location;

raising the overhead belt assembly from the first item or the first substrate and the one or more items;

moving the at least one platform and dropping the first item or the first substrate with the one or more items onto a stacking position; and repeating the process with second and subsequent items or substrates with one or more items thereon until a predetermined count of stacked items or substrates with one or more items is reached.

Preferably, the at least one platform is closed after the item or the substrate with the items is dropped and the overhead belt assembly is then lowered back to the at least one platform and the process is started again for subsequent substrates. Once a predetermined count is reached at the stacking position on the outfeed conveyor, the outfeed conveyor is activated to transport the stacked substrates with the one or more items thereon, preferably for further processing and/or packaging.

BRIEF DESCRIPTION OF THE DRAWINGS

The foregoing summary and the following detailed description will be better understood when read in conjunction with the appended drawings. For the purpose of illustrating the invention, there are shown in the drawings embodiments which are presently preferred. It should be understood, however, that the invention is not limited to the precise arrangements shown. In the drawings:

FIG. 6 is a side elevational view similar to FIGS. 2-5 showing the conveying and stacking apparatus with two substrates with items thereon stacked in a stacking position and a third substrate with items thereon proceeding down the infeed conveyor prior to entering the stacker;

FIG. 7 is a partial top view showing the infeed conveyor, stacking platforms and outfeed conveyor;

FIG. 8 is a schematic side elevational view showing a preferred arrangement of the overhead loading belt assembly;

Figure 1:
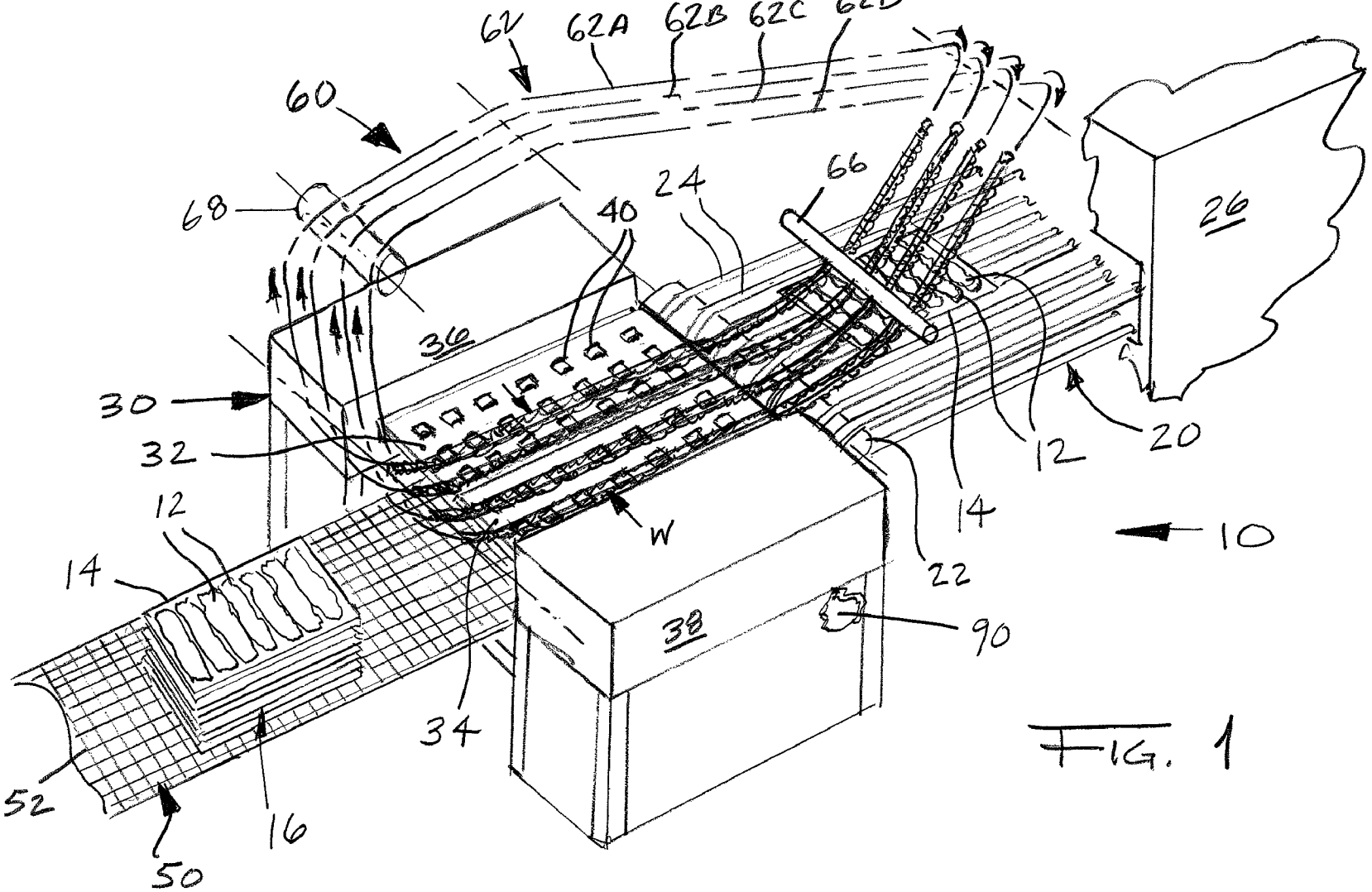
FIG. 1 is a perspective view of the conveying and stacking apparatus according to the invention.

Appendix A is attached with photographs of a conveying and stacking apparatus according to the invention, with a first embodiment including the multi-chain overhead belt assembly and the second embodiment including the polymeric link belt assembly.

DETAILED DESCRIPTION OF THE PREFERRED EMBODIMENTS

Certain terminology is used in the following description for convenience only and is not considered limiting. The words "lower" and "upper" designate directions in the drawings to which reference is made. The terms "a" and "one" are defined as including one or more of the referenced item unless specifically noted. The "at least one belt assembly" refers to a polymeric link belt, a woven mesh belt, a plurality of separate chains arranged to travel in sync with one another that act as a belt, or other types conveying belts which can be arranged as the overhead belt assembly described below.

Referring now to FIG. 1, a conveying and stacking apparatus 10 for items or stacking substrates 14 with one or more items 12 located thereon which are received from an infeed conveyor 20 is shown. While the figures show the equipment and method with items 12 arranged on substrates 14, such as cooked bacon on paper substrates, the apparatus 10 and method can be used to stack single items, such as frozen pizza shells, which are usually difficult to stack. In the preferred embodiment, the infeed conveyor 20 includes bands 24 which are wrapped around an end roller 22 which are used for carrying the substrate 14 with the items 12 thereon from processing equipment 26, such as a cooker and/or slicer and/or interleaver. In the preferred embodiment, the processing equipment 26 is equipment for cooking bacon and placing slices of bacon upon the substrate 12. Alternatively, it can be equipment that produces frozen pizza shells. While the preferred infeed conveyor 20 is a band conveyor, it is possible that other types of conveyors using belts could be utilized.

Still with reference to FIG. 1, a stacker 30 is located adjacent to the infeed conveyor 20 in order to receive the substrates 14 carrying the items 12 thereon for stacking. The stacker 30 includes a housing, preferably provided as housing halves 36 and 38, located on either side of an outfeed conveyor 50. At least one and preferably first and second moveable stacking platforms 32, 34 are provided in the stacker 30, with the first stacking platform 32 extending from the first housing side 36 and the second stacking platform 34 extending from the second housing side 38. As shown in FIG. 7, preferably the first stacking platform 32 is movable via an actuator 44 such that it can be moved from a deployed position indicated at 32 to a retracted position indicated at 32' via the actuator 44. At the same time, the second stacking platform 34 is moveable via an actuator 46 from the loading position indicated at 34 to a retracted position indicated at 34'. Through suitable control and actuation of the actuators 44, 46, both stacking platforms 32 and 34 are withdrawn allowing an item or a substrate carrying a product located on the stacking platforms 32, 34 to be dropped through the opening, created by the stacking platforms 32, 34 being withdrawn, to a stacking position provided by an outfeed conveyor 50.

The actuators 44, 46 can be electrical motor driven actuators or pneumatic actuators, and are used to slidingly withdraw the stacking platforms 32, 34, or in the case of rotating stacking platforms that hinge downwardly from the edges to open, are used to rotate the stacking platforms 32, 34 open and closed. While the illustrated sliding platforms 32, 34 slide transverse to the direction of travel of the conveyor 20, they could also be arranged to slide in the conveyor direction.

The outfeed conveyor 50 preferably includes a belt 52 and at least a return roller 54, and can be used for carrying a stack 16 of the substrates 14 with the items 12 thereon or just a stack of items 12 to a down stream operation, such as further processing or packaging of the stack of the substrates with the items thereon. The outfeed conveyor 50 can be of any suitable type of moving belt conveyor.

Figure 9:
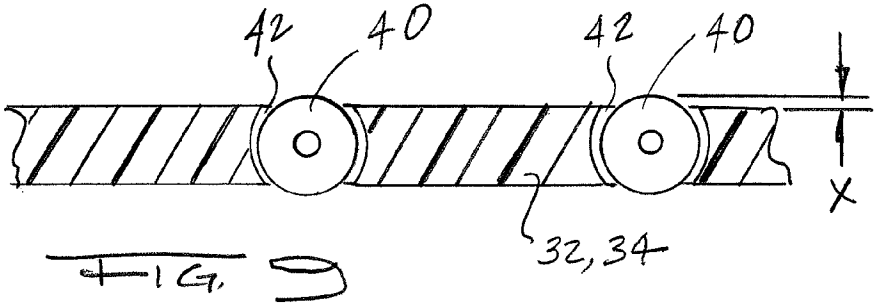
FIG. 9 is a partial cross-sectional view through a stacking platform.

Referring to FIG. 9, preferably the stacking platforms, 32, 34 include a plurality of rollers 40 arranged in openings 42. Preferably, the rollers 40 extend a distance X above a top surface of the stacking platforms 32, 34 which is in the range of 0.05 to approximately 0.25 inches. More preferably, the rollers extend approximately 0.1 to 0.15 inches above the upper surface of the stacking platforms 32, 34. The rollers 40 are preferably free-rolling, and the axes of the rollers 40 extend in a direction transverse to a direction of movement of the overhead loading belt 62, which is described in detail below. The rollers 40 help to ensure uniform placement of the substrates 14 with the items 12 or just items to be stacked in a uniform stacking position by eliminating drag due to contamination or build-up of pieces of the items being stacked on the surfaces of the platforms 32, 34. The contaminants and build-up don't allow the items or substrates with items to slide uniformly, and can cause the items or substrates to skew.

Figure 10:
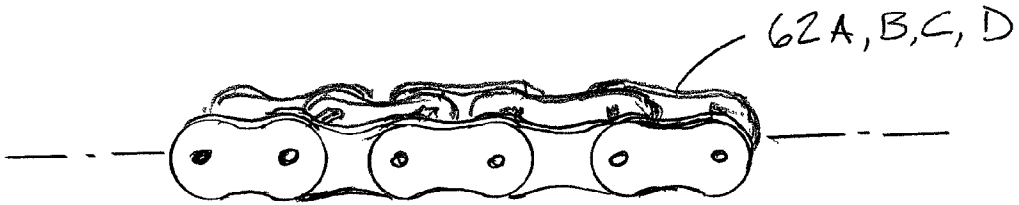
FIG. 10 is a perspective view showing a segment of one of the spaced apart chains which comprise the at least one belt assembly.
Figure 11:
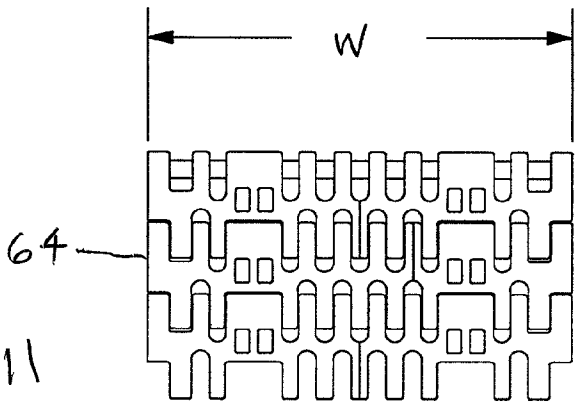
FIG. 11 is a top view of a polymeric link belt which forms the at least one belt assembly in another embodiment of the invention.
Figure 12:
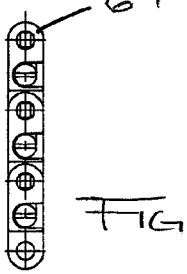
FIG. 12 is a side view of the polymeric link belt of FIG. 11.

Referring again to FIG. 1, an overhead loading belt assembly 60 including at least one belt assembly 62 is positioned to travel on top of at least a portion of the infeed conveyor 20 adjacent to the at least one moveable stacking platform 32, 34 as well as the at least one moveable stacking platform 32, 34 to carry the items or the substrate 14 with the items 12 located thereon to a stacking position on the at least one platform 32, 34. Preferably, the at least one belt assembly 62 is comprised of a plurality of chains 62A, 62B, 62C, 62D as indicated in FIG. 1 and shown in detail in FIG. 10. The chains 62A-62D are preferably made of stainless steel and are compatible with automated food handling requirements. Alternatively, the at least one belt assembly comprises a polymeric link belt 64 as shown in FIGS. 11 and 12. One such belt is available from Rexnord as a 7700 Series Mattop R Chain Product under Model No. 7708. Another belt is HabasitLINK® Staright 1" Pitch Belting M2533 Flush Grid 1", which is available from Habasit America, Suwanee, Ga. However, other types of belt assemblies, including a woven metal mesh, woven polymeric or other suitable belts can be used, depending upon the item being stacked.

As shown in detail in FIGS. 1-4, the belt assembly 62, 64 includes a slack portion which travels on top of the portion of the infeed conveyor 20 adjacent to the stacking platform 32, 34 and over the stacking platform 32, 34. This slack portion of the at least one belt assembly 62, 64 contacts and holds the items 12 on the substrate 14 in a relatively fixed position (i.e., the items 12 are held in place on the substrate 14) and moves the combination of the substrate 14 with the items 12 from the end of the infeed conveyor 20 onto the at least one stacking platform 32, 34. Alternatively, if items 12 are being stacked without substrates, the belt assembly 62, 64 engages the surface of the item(s) without damaging them. In the preferred embodiment, the width W of the at least one belt assembly 62, 64 is approximately equal to or greater than 50% of a width of the substrate 14. For use in stacking items without substrates, the width W is preferably at least 50% as wide as or wider than the item. In a preferred embodiment, this is between 8 and 12 inches. In the embodiment where the spaced apart chains 62A, 62B, 62C, 62D form the at least one belt 62, the width W is defined between the outer-most ones of the chains 62A and 62D as indicated with the dimension "W" in FIG. 1. The width W for the polymeric link belt is indicated in FIG. 11.

Referring now to FIG. 8, the overhead loading belt assembly 60 preferably includes a moveable roller 68 which can be moved via an actuator 69 between a first position, where the at least one belt assembly 62 is allowed to drop into contact with at least one of the platform 32, 34 or the substrate 14 with the one or more items 12 located thereon which is to be stacked that is positioned on the at least one platform 32, 34, and a second position, indicated at 68' in FIG. 8 where the at least one belt assembly 62, 64 is located in a position that does not contact the at least one of the platform 32, 34 or the substrate 14 with the one or more items 12 located thereon to be stacked that is positioned on the platform 32, 34. This raised position of the at least one belt 62, 64 is shown more clearly in FIG. 5, which does not show the moveable rollers 68.

Referring again to FIG. 8, the at least one belt 62, 64 is guided via guide rolls 70, 72, 74 and driven via a drive motor 78 connected to a drive roll or gear 76 which engages with the at least one belt 62, 64. Additionally, a tensioning roller 66 is shown in a position above the end roller 22 of the infeed conveyor 20 which maintains the contact position of the at least one belt 62, 64 with the end of the infeed conveyor 20.

Still referring to FIG. 8, at least one sensor 80 is positioned to sense the substrate 14 being carried onto the at least one platform 32, 34. Alternatively, it can sense the item(s) if no substrate is used. The sensor 80 is connected and sends a signal to a controller 90 (shown in FIG. 1) that controls movement of the at least one belt assembly 62, 64 based on a signal from the sensor 80 so that item or the substrate 14 with the items 12 can be stopped in a repeatable location on the at least one platform 32, 34. The sensor 80 is preferably a break-beam or photo-eye sensor that detects a leading and/or trailing edge of the substrate 14.

Figure 3:
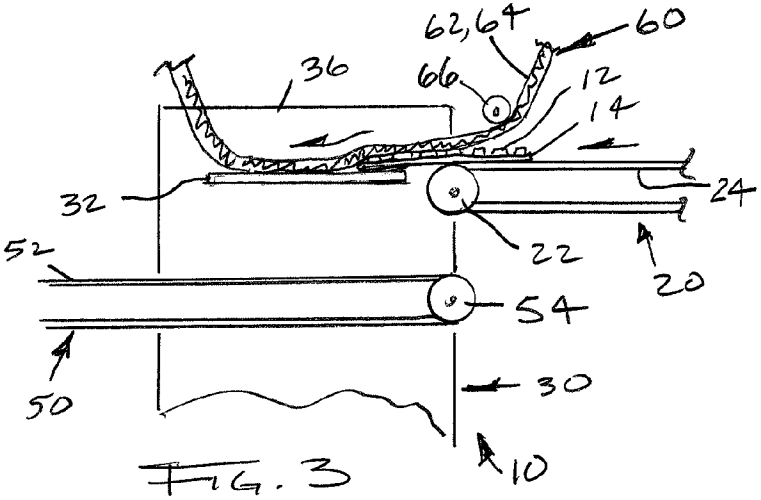
FIG. 3 is a side elevational view similar to FIG. 2 showing the substrate carrying items thereon being dragged onto the stacking platform.
Figure 2:
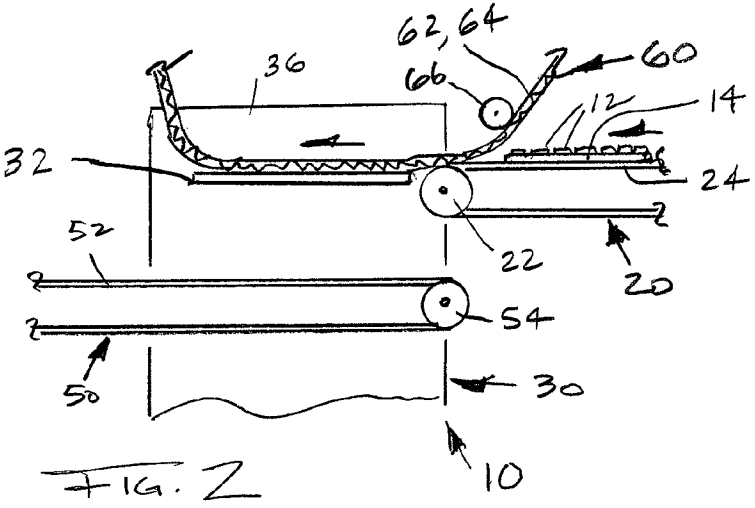
FIG. 2 is a schematic side view showing the conveying and stacking apparatus for stacking substrates carrying items thereon received from an infeed conveyor, where the substrate is shown in a position on the infeed conveyor prior to being dragged onto the stacking platform.
Figure 5:
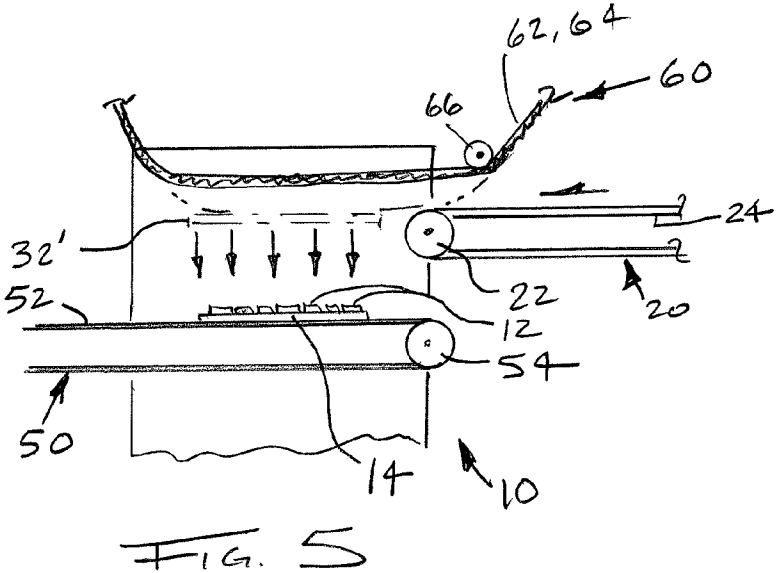
FIG. 5 is a side elevational view similar to FIGS. 2-4 schematically illustrating the overhead belt being raised and the stacking platform dropping the substrate with the items thereon to a stacking position.
Figure 4:
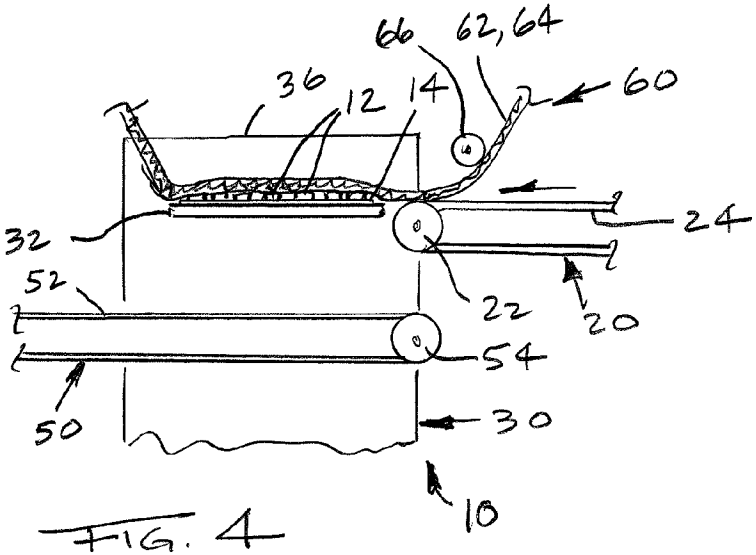
FIG. 4 is a schematic side view similar to FIGS. 2 and 3 showing the substrate with the items thereon positioned on the stacking platform.

As shown in FIGS. 2-4, the item or the substrate 14 with the items 12 located thereon is initially carried by the infeed conveyor 20 toward the end roller 22. As shown in FIG. 2, the at least one belt assembly 62, 64 then engages an upper surface of the substrate 14 and/or the one or more items 12 located thereon holding the items 12 in a fixed position relative to the substrate 14. If there is no substrate, the at least one belt assembly engages with upper surface of the item. The at least one belt assembly 62, 64 is driven via the motor 78 and drive roll/gear 76 until the item or the substrate 14 with the one or more items 12 thereon is carried into the repeatable location on the at least one platform 32, 34 as shown in FIG. 4. The at least one belt 62, 64 is then stopped via the controller 90 stopping the motor 78, such that the at least one belt assembly 62, 64 stops its movement in a repeatable fashion. At this point, as shown in FIG. 5, the actuator 69 for the moveable roller 68 is activated by the controller 90 in order to lift the at least one belt assembly 62, 64 into the position shown in FIG. 5 in which it is out of contact with the platform 32 and/or the item or the substrate 14 with the one or more items thereon 12 located on the platform 32. The at least one platform 32, 34 is then opened in order to drop the item or the substrate 14 with the items 12 thereon to a stacking position.

In the preferred embodiment, shown in FIG. 7, the stacking platforms 32, 34 are withdrawn into the housings 36, 38, respectively, via the actuators 44, 46, respectively, which are activated by the controller 90. This allows the item or the substrate 14 with the items 12 located thereon to drop in a relatively uniform and repeatable manner onto a stacking position on the outfeed conveyor 50. It is also possible to utilize stacking platforms 32, 34 which rotate downwardly as shown in the photographs appended hereto of prototype equipment according to the invention. After the item or the substrate 14 with the items 12 is dropped into the stacking position, the controller 90 activates the actuator 69 to return the removable roller 68 to a position in which the at least one belt 62, 64 again is in contact with the infeed conveyor 20 as well as the at least one stacking platform 32, 34 such that the conveying and stacking apparatus 10 is ready to receive a next item or next substrate 14 with one or more items 12 thereon to be stacked upon a previously stacked item or substrate 14 in order to form the stack 16, as shown in FIG. 6. It is noted in FIG. 6 that two substrates have already been stacked onto the outfeed conveyor 50 and a third substrate 14 with items 12 located thereon is located on the infeed conveyor 20 in a position similar to the position shown in FIG. 2, whereupon the process illustrated in FIGS. 2 through 5 is again repeated in order to build upon the stack 16.

Once a predetermined number of substrates 14 with the one or more items have been stacked in the stack 16, the controller 90 controls movement of the outfeed conveyor 50 in order to move the stack 16 to a downstream position for further processing or packaging. This operation would be similarly carried out for a stack of items without substrates.

Referring again to FIG. 8, it has been found that the use of the tensioning roller 66 provides for a more uniform movement of the at least one belt assembly 62, 64 in order to ensure uniform and reliable positioning of items or substrates 14 with items 12 thereon on the stacking platforms 32, 34. In the preferred embodiment the tensioning roller 66, as well as the guide rollers 70, 72 and 74, are made of a polymeric material that is suitable for food processing equipment. The drive roll/gear 76 is preferably also made of a suitable polymeric material. The moveable roller 68 can also be made of a suitable polymeric material and the actuator 69 can be a rotary or a linear actuator which is used to either rotate or displace the roller 68 such that the slack in the at least one belt 62, 64 is taken up, raising the lower run of the at least one belt assembly 62, 64 from the stacking platform 32, 34.

In a preferred embodiment, the rollers 66, 68, 70, 72 and 74 are all mounted in a cantilever fashion so that the belt assembly 62, 64 can be removed in a simple fashion for cleaning by sliding it off the ends after tension provided by the moveable roller 68 is released. The drive roll/gear 76 is also mounted in a cantilever manner from a shaft of the drive motor 78 to facilitate the easy removal of the at least one belt 62, 64.

In a method for stacking a plurality of substrates 14, with each of the substrates 14 carrying one or more items 12 thereon, the following steps are carried out. First, a substrate 14 with one or more items 12 thereon is received on an infeed conveyor 20, preferably from processing equipment 26 as shown in FIG. 1. The first substrate 14 is then conveyed under an overhead belt assembly 60 via the infeed conveyor 20 causing the one or more items 12 and the substrate 14 to be held together in a relatively fixed position between the infeed conveyor 20 and the overhead belt assembly 60. The substrate 14 with the one or more items 12 thereon is moved by the overhead belt assembly 60 onto at least one stacking platform 32, 34. The movement of the first substrate 14 with the items thereon onto the at least one stacking platform 32, 34 is sensed via the sensor 80 which signals the controller 90 which, based on the speed of the overhead belt and the size of the substrate 14 stops the overhead belt assembly 62, 64 once a predetermined location is reached on the stacking platform 62, 64. At that point, the controller 90 signals the actuator 69 for the moveable roller 68 such that the at least one belt assembly 62, 64 is raised from the substrate 14 and the one or more items 12 located thereon. The controller 90 then signals the stacker 30 to drop the substrate 14 with the items thereon, preferably via activating the actuators 44, 46 in order to slide the stacking platforms 32, 34 in a transverse direction to a direction of movement of the at least one belt 62, 64, as shown in FIGS. 5 and 7. This drops the substrate 14 with the one or more items 12 thereon onto a stacking position on the outfeed conveyor 50. This process is repeated with second and subsequent substrates 14 with one or more items 12 thereon until a predetermined count is reached. Preferably, this includes having the controller 90 close the at least one platform 32, 34 after the first substrate 14 with the item 12 thereon is dropped and the controller also activates the actuator 69 in order to move the moveable roller 68 back into a position where the overhead belt assembly 62, 64 is lowered onto the at least one platform. Once the predetermined count is reached, the controller 90 activates the outfeed conveyor 50 to transport the stacked substrates with the items 12 thereon to a position for further processing and/or packaging.

This process is similarly applicable for directly stacking items that are not provided on substrates.

By using the conveying and stacking apparatus 10 according to the present invention, increased speeds can be achieved for stacking products such as cooked bacon, which are supplied in a single layer on substrates 14 which must be stacked for packaging. Similar improvements can be made for stacking items without substrates that are typically difficult to stack, such as frozen pizza shells. The invention provides for both accurate and repeatable placement which is not achievable at high speeds in the known systems. The preferred stacker 30 utilizes the sliding stacking platforms 32, 34 in order to minimize the drop height between the platforms 32, 34 and the outfeed conveyor 50. The drop height to the outfeed conveyor 50 is preferably in the range of approximately 5 inches for the first substrate 14 dropped, and decreases for the subsequent substrates 14 in each stack 16. However, depending upon the particular items being stacked, it is also possible to use a rotating paddle type stacker in which the stacking platforms 32, 34 are rotated downwardly in order to drop the substrate with the items thereon into the stacking position. This is shown in the Appendix with pictures of the prototype.

According to the invention, a further advantage is provided in that the stacking platforms 32, 34 are provided with rollers 40. This allows for more uniform positioning of the substrates 14 with the one or more items 12 thereon on the stacking platforms 32, 34, and helps to maintain the relative fixed position between the items 12 and the substrate 14.

Through a combination of one or more features of the above invention, advantages in both processing speed and accuracy of stacking are achieved in comparison with the known stacking technology. While the invention has been disclosed in terms of stacking substrates 14 with one or more items 12 thereon, it is also applicable for stacking items that don't require substrates in a uniform manner.

While the invention has been described in detail based on the presently preferred embodiments, it will be recognized by those skilled in the art that the invention is not limited to the preferred embodiments, but rather is defined by the appended claims.

What is claimed is:

1. A conveying and stacking apparatus for stacking items or substrates carrying items thereon received from an infeed conveyor, comprising:

a stacker having a housing and at least one movable platform upon which the item or the substrate with one or more items located thereon is placed;

an overhead loading belt assembly including at least one belt assembly positioned to travel on top of at least a portion of the infeed conveyor adjacent to the at least one moveable platform and the at least one movable platform with a slack portion of the at least one belt assembly to carry the item or the substrate with the one or more items located thereon to a stacking position on the at least one platform; and a movable roller that can be moved between a first position where the slack portion of the at least one belt assembly is in contact with at least one of the at least one moveable platform or the item or the substrate with the one or more items located thereon to be stacked positioned on the at least one platform, and a second position where the slack portion of the at least one belt assembly is lifted to a position that does not contact the at least one of the platform or the item or the substrate with the one or more items located thereon to be stacked positioned on the platform, and the movable roller is in the second position during actuation of the at least one movable platform.

2. The conveying and stacking apparatus of claim 1, further comprising:

an outfeed conveyor located under the stacker for receiving the item or the substrate with the one or more items thereon to be stacked.

3. The conveying and stacking apparatus of claim 1, wherein the at least one belt assembly comprises a polymeric link belt having a width that is about equal to or greater than a width of the substrate.

4. The conveying and stacking apparatus of claim 1, wherein the at least one belt assembly comprises a plurality of spaced-apart chains, with a width defined between outermost ones of the chains being about equal to or greater than a width of the substrate.

5. The conveying and stacking apparatus of claim 1, wherein the overhead loading belt assembly includes a plurality of rollers for guiding the at least one belt assembly, such that the slack portion of the belt assembly travels on the portion of the infeed conveyor and the at least one platform.

6. The conveying and stacking apparatus of claim 1, further comprising a sensor that is positioned to sense at least one of the item or the substrate being carried onto the at least one platform, and a controller that controls movement of the at least one belt assembly based on a signal from the sensor so that the item or the substrate with the one or more items can be stopped in a repeatable location on the at least one platform.

7. The conveying and stacking apparatus of claim 6, wherein the controller further controls movement of the movable roller so that the at least one belt assembly is moved to the second position once the item or the substrate with the items is stopped in the repeatable location for stacking.

8. The conveying and stacking apparatus of claim 7, wherein the controller controls movement of the at least one movable platform from a first, loading position, to a second, opened position for dropping the item or the substrate with the one or more items to be stacked into a stacked position.

9. The conveying and stacking apparatus of claim 8, wherein the stacked position comprises an outfeed conveyor located under the stacker for receiving the item or the substrate with the one or more items to be stacked, and the controller controls movement of the outfeed conveyor after a predetermined number of the items of the substrates with the items located thereon have been stacked.

10. The conveying and stacking apparatus of claim 1, wherein the at least one platform comprises first and second platforms that are slidable toward and away from one another in a direction transverse to a direction of movement of the at least one belt assembly.

11. The conveying and stacking apparatus of claim 10, wherein the first and second platforms each include a plurality of rollers, and the rollers have axes arranged transverse to a direction of movement of the at least one belt assembly.

12. The conveying and stacking apparatus of claim 11, wherein the rollers are arranged in a plurality of rows on each of the platforms.

13. The conveying and stacking apparatus of claim 11, wherein the rollers protrude approximately 0.05 to 0.25 inches from a top surface of the platforms.

14. The conveying and stacking apparatus of claim 1, further comprising the infeed conveyor.

15. The conveying and stacking apparatus of claim 14, further comprising a tensioning roller located above the infeed conveyor for guiding the at least one belt assembly to a contact position with the infeed conveyor in proximity to an end roller adjacent to the at least one platform.

16. A method for stacking a plurality of items or substrates, each of the substrates carrying one or more items, comprising:

receiving a first item or a first substrate with one or more items thereon on an infeed conveyor;

conveying the first item or the first substrate with the one or more items under an overhead belt assembly;

moving the first item or the first substrate with the items thereon with a slack portion of the overhead belt assembly onto at least one stacking platform;

sensing the first item or the first substrate with the one or more items entering the at least one platform and, based on a signal from the sensor;

stopping the overhead belt assembly so that the first item or the first substrate with the one or more items thereon is located at a predetermined location;

raising the slack portion of the overhead belt assembly from the first item or the first substrate and the items thereon;

moving the at least one platform and dropping the first item or the first substrate with the one or more items thereon onto a stacking position; and repeating the process with second and subsequent items or substrates with one or more items thereon until a predetermined count is reached.

17. The method according to claim 16, further comprising:

closing the at least one platform after the item or the substrate with the one or more items is dropped;

lowering the overhead belt assembly back to the at least one platform; and starting the process again for a subsequent item or substrate.

18. The method according to claim 17, wherein the stacking position is on an outfeed conveyor, and when the predetermined count is reached, activating the outfeed conveyor to transport the stacked items or substrates with the items thereon.

19. The method according to claim 16, wherein the overhead belt assembly causes the one or more items and the substrate to be held together in a relatively fixed position between the infeed conveyor and the overhead belt assembly.

* * * * *